US006278937B1

(12) United States Patent
Ishida et al.

(10) Patent No.: US 6,278,937 B1
(45) Date of Patent: Aug. 21, 2001

(54) METHOD AND APPARATUS FOR CONTROLLING THE POSITION OF FLOATING RIG

(75) Inventors: Shigeki Ishida, Ichihara; Susumu Tanaka, Chuo-Ku, both of (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 0 days.

(21) Appl. No.: 09/541,053

(22) Filed: Mar. 31, 2000

(30) Foreign Application Priority Data

Apr. 6, 1999 (JP) ..... 11-98338

(51) Int. Cl.[7] ..... E21B 44/00; G06F 15/50

(52) U.S. Cl. ..... 701/207; 405/195; 175/5; 175/7; 114/144; 114/264; 166/352

(58) Field of Search ..... 701/207, 116; 364/432, 449, 560; 702/6; 73/155; 166/5

(56) References Cited

U.S. PATENT DOCUMENTS

| | | | | |
|---|---|---|---|---|
| 4,098,333 | * | 7/1978 | Wells et al. | 166/5 |
| 4,205,379 | * | 5/1980 | Fox et al. | 364/432 |
| 4,351,027 | * | 9/1982 | Gay et al. | 364/432 |
| 5,205,165 | * | 4/1993 | Jardine et al. | 73/155 |
| 5,978,739 | * | 11/1999 | Stockton | 702/6 |

FOREIGN PATENT DOCUMENTS

| | | |
|---|---|---|
| 1 510 624 | 5/1978 | (GB) . |
| 1 586 425 | 3/1981 | (GB) . |
| 2 083 220 * | 3/1982 | (GB) . |

* cited by examiner

*Primary Examiner*—William A. Cuchlinski, Jr.
*Assistant Examiner*—Tuan C To
(74) *Attorney, Agent, or Firm*—Oliff & Berridge PLC

(57) ABSTRACT

Disclosed is a system for controlling the position of a floating rig that permits holding the rig at a position optimum to an excavation riser even if a position signal of the floating rig is not received, provided that the angles of inclination at the upper and lower ends of the riser are detected. In the method of controlling the position of a floating rig, the floating rig 10 is joined to a well head 14 at the sea bottom by an excavation riser 16, and the rig 10 is driven to a corrected position by thrusters or a combination of thrusters and a propulsion system. A neural network is allowed to learn in advance the position information of the floating rig accompanying the behaving characteristics of the excavation riser. The angles of inclination at the upper and lower ends of the excavation riser are detected and a signal represent of the detected angles is supplied to the neural network so as to permit the neural network to output the information on the correction of the present position of the floating rig. Based on the position information, the correcting information that permits diminishing the angles of inclination at the upper and lower ends of the riser is calculated so as to automatically control the position of the floating rig. Where the position information of the floating rig has ceased to be received, the angles of inclination at the upper and lower ends of the excavation riser that are to be detected are supplied to the position estimating section of the rig based on the algorithm of Kalman filter so as to estimate the rig position and, thus, to perform the position control.

4 Claims, 2 Drawing Sheets

METHOD AND APPARATUS FOR CONTROLLING THE POSITION OF FLOATING RIG

BACKGROUND OF THE INVENTION AND RELATED ART STATEMENT

The present invention relates to a method and apparatus for controlling the position of a floating rig, particularly, to a method and apparatus for controlling the position of a floating rig joining a rig and a well head positioned on the sea bottom by an excavation riser.

Where there a floating rig operating in deep water having a depth exceeding 1,000 meters, it is necessary to hold upright an excavation riser joining the rig and a well head positioned in the sea bottom. Used nowadays for this holding operation is a dynamic positioning system (DPS) for holding the excavation riser at a predetermined position by using thrusters or a combination of thrusters and a propulsion system. In this case, the information on the position of the rig is obtained from signals supplied from acoustic equipment or artificial satellites for performing a desired control. What should be noted in this case is that, if the information on the position of the rig ceases to be received, it is impossible to perform control to maintain the position. What should also be noted is that, if the marine weather conditions are aggravated, the acoustic signal looses its reliability and Differential Global Positionig System (DGPS) signal supplied from the artificial satellite tends to be interrupted. Such being the situation, employed in general is a system in which the position information is obtained by at least three sensor systems and by at least two kinds of sensors differing from each other in the principle of measurement.

Where the water depth is not larger than 300 meters, the anchor at the sea bottom and the floating rig are joined to each other by a wire (taut wire). In the position control of the rig in such a low water depth, the angle of inclination of the wire is changed by the movement of the rig. Therefore, the rig position is maintained by operating the system according to a signal recieved representing a change in the angle of inclination. The tension of the wire is adjusted if necessary.

However, in a sea having a water depth exceeding 1,000 meters, the wire joining the floating rig and the sea bottom is drifted by a current, making it impossible to control effectively the rig position. Also, a system, in which the rig position is controlled by receiving a signal representing the angle of inclination at the lower end of the riser, is employed in place of the wire. In this system, however, it is said to be impossible to perform an effective positioning control in a deep sea having a water depth exceeding 1,000 meters.

Further, the actual operation carried out is such that the angles of inclination at the upper and lower ends of the riser are perceived visually by the operator and the control target position of DPS is determined manually by the operator.

Still further, a shaft of an excavation drill is housed inside the excavation riser, making it necessary to diminish the angle of inclination of the riser to prevent the riser and the excavation drill shaft from interfering with each other. In the conventional apparatus, however, the position is not controlled depending on the angle of inclination of the riser, making it impossible to perform simply the control to maintain the position, and the control is dependent on the degree of skill of the operator.

SUMMARY OF THE INVENTION

An object of the present invention, which has been achieved in view of the situation described above, is to provide a system that permits a floating rig to be automatically held at a position optimum to the riser, even if a position signal of the floating rig is not available, provided that the angles of inclination of the upper and lower ends of the riser can be detected.

To achieve the object, the present invention is directed to a method of controlling the rig position using an excavation riser. The method of the invention makes it possible to estimate accurately the rig position based on the angles of inclination at the upper and lower ends of a riser such that the rig position can be held based on only the information of the angles of inclination at the upper and lower ends of the riser. A neural network is used for calculating the position correcting amount of the floating rig in the direction in which the angles of inclination at the upper and lower ends of the riser are diminished.

To be more specific, the first embodiment of the present invention is directed to a method of controlling the position of a floating rig, in which the floating rig is joined to the well head at the sea bottom by an excavation riser. The position of the floating rig can then be corrected by thrusters, or a combination of thrusters and a propulsion system, wherein a neural network is allowed to learn in advance the position information of the floating rig in relation to the behaving characteristics of the excavation riser, such that the angles of inclination at the upper and lower ends of the excavation riser are detected and supplied to the neural network to allow the neural network to output information for correcting of the present position of the floating rig, by driving the floating rig based on the correcting information from a present position of the rig to a position where the angles of inclination at the upper and lower ends of the riser are diminished. Thus, controlling the position of the floating rig at the position where the angles of inclination at the upper and lower ends of the riser are diminished is achieved.

The second embodiment of the present invention is directed to a method of controlling the position of a floating rig, in which the floating rig is joined to the well head at the sea bottom by an excavation riser and the position of the floating rig can be corrected by thrusters, or a combination of thrusters and a propulsion system, wherein a deviation in the rig position is calculated based on position information supplied from the means for detecting the position of the rig. Again, a neural network is allowed to learn in advance the position information of the floating rig in relation to the behaving characteristics of the excavation riser to output the information for correcting amount the target position by supplying the information on detected angles of inclination at the upper and lower ends of the excavation riser to the neural network, and driving the thrusters, or a combination of the thrusters and a propulsion system, to perform correction of the rig position while diminishing the angle of inclination of the excavation riser.

Further, the third embodiment of the present invention is directed to a method of controlling the position of a floating rig, in which the floating rig is joined to the well head at the sea bottom by an excavation riser and the position of the floating rig can be corrected by thrusters, or a combination of thrusters and a propulsion system, wherein a neural network is allowed to learn in advance the position information of the floating rig in relation to the behaving characteristics of the excavation riser. The angles of inclination at the upper and lower ends of the excavation riser are detected and the information on the detected angles is supplied to the neural network, thereby allowing the neural network to output the information on the correcting amount of the target position of the floating rig, estimating the position of the floating rig based on the received information, obtaining a deviation between the estimated position and the target position, and driving the thrusters or a combination of the thrusters and a propulsion system, to perform correction of the rig position while diminishing the angle of inclination of the excavation riser.

The present invention also provides an apparatus for controlling the position of a floating rig, in which the floating rig is joined to the well head at the sea bottom by an excavation riser and the position of the floating rig can be corrected by thrusters, or a combination of thrusters and a propulsion system. The position control apparatus comprises a target position deviation calculating section for calculating the deviation in the rig position based on the position information supplied from the means for detecting the rig position, a target position correcting amount calculating section, in which a neural network is allowed to learn in advance the position information of the floating rig in relation to the behaving characteristics of the excavation riser and the angles of inclination at the upper and lower ends of the excavation riser are detected and supplied to the neural network to permit the neural network to output the information on the target position correcting amount of the floating rig, a position estimating section for estimating the position of the floating rig based on a signal representing of the detected angles of inclination at the upper and lower ends of the excavation riser to obtain a deviation between the estimated position and the target position, a main calculating section for outputting a command value to the thrusters, or a combination of the thrusters a propulsion system, and a switching means that selects the input route to the main calculating section from among the deviation calculating section, a combination of the deviation calculating section and the target position correcting amount calculating section, and another combination of the target position correcting amount calculating section and the rig position estimating section.

The particular construction of the present invention permits an automatic control to diminish the inclination angle of the upper and lower ends of the excavation riser by using the calculating processing of the target position correcting amount using a neural network in addition to the conventional DPS control. Further, even if the position information on a floating rig has ceased to be received, the position control can be switched to a combination of the calculating processing of the target position correcting amount using the neural network and the calculating processing of the position estimated by the inclination angle of the upper and lower ends of the excavation riser, provided that information on the inclination angles of the upper and lower ends of the riser is available. In excavating in a deep sea, there are some cases where the bad marine weather conditions ruin the reliability of acoustic signal and break DGPS signals from an artificial satellite. In such a case, the position signal ceases to be received, though such a probability is very low. However, the system of the present invention makes it possible to control the position of the floating rig having a high reliability whithin the context of a DPS system.

DETAILED DESCRIPTION OF THE PREFERRED EMBODIMENT

A method of controlling the position of a floating rig according to one embodiment of the present invention will now be described in detail with reference to the accompanying drawings.

Figure 1:
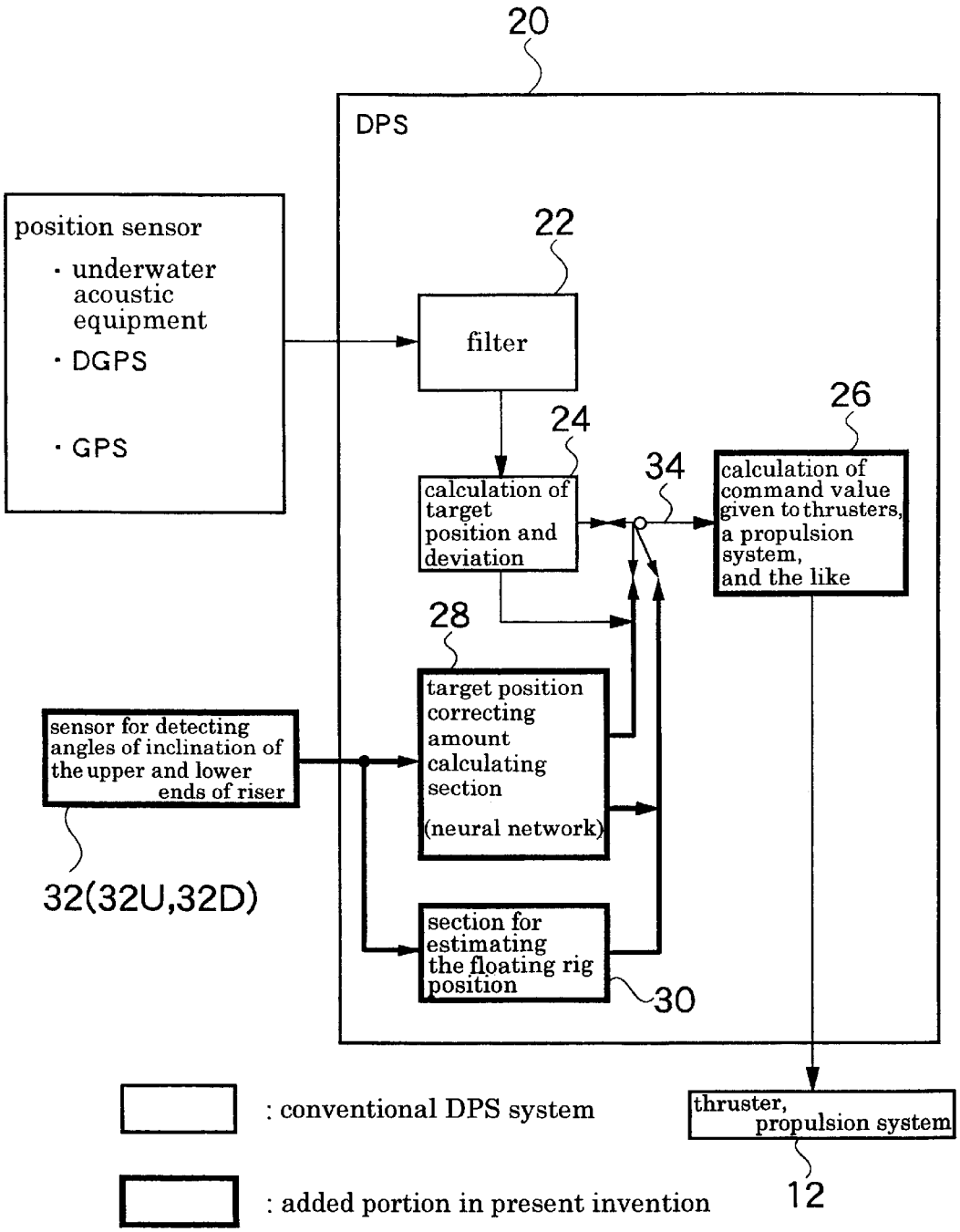
FIG. 1 is a block diagram showing the construction of an apparatus for controlling the position of a floating rig according to one embodiment of the present invention.
Figure 2:
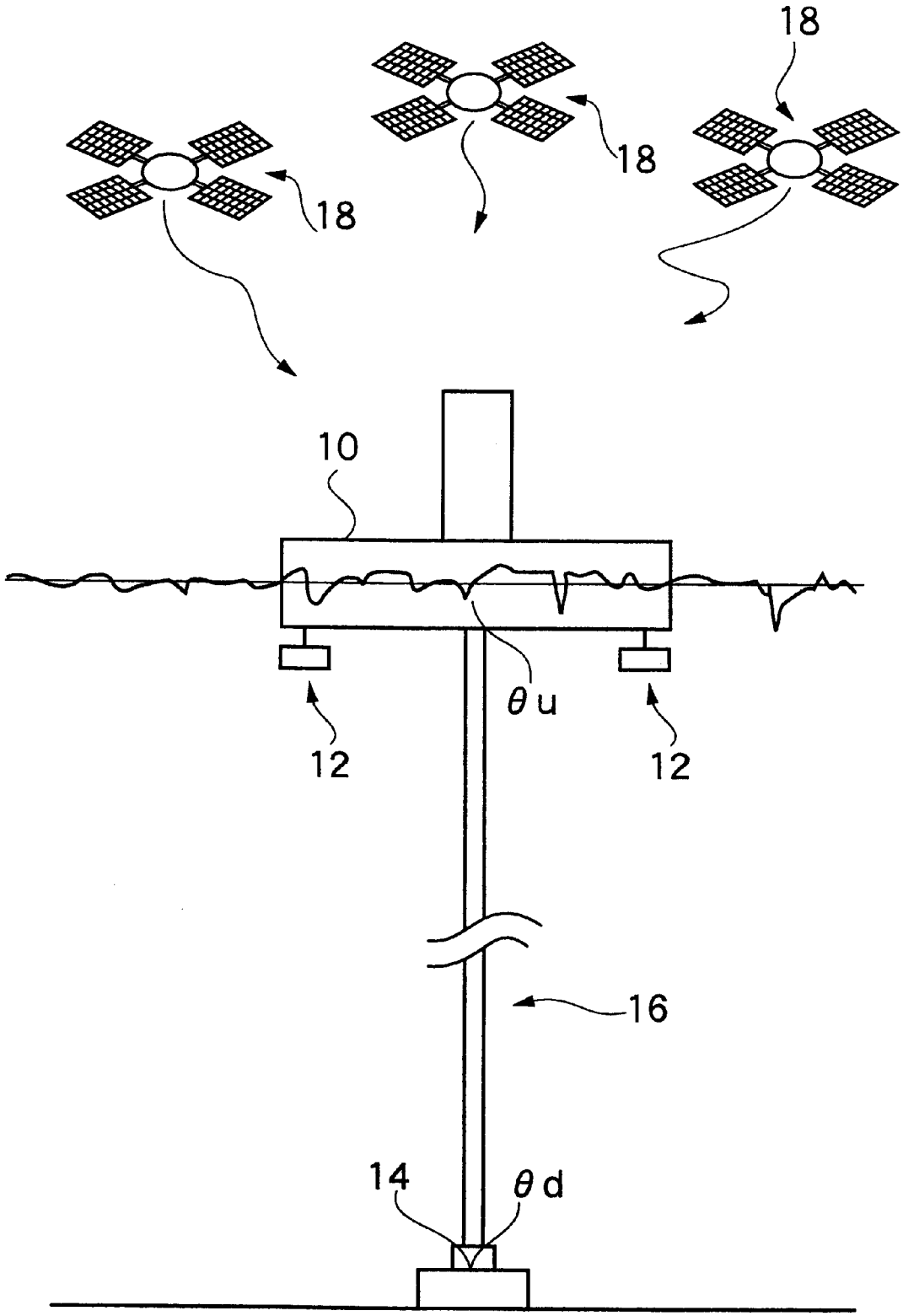
FIG. 2 shows how a floating rig is operated.

FIG. 1 is a block diagram showing the construction of an apparatus for putting the method of the present invention into practice to control the position of a floating rig, and FIG. 2 shows the positional relationship between the floating rig and a structure on the sea bottom. A floating rig 10 can be moved on the water surface by thrusters, or by thrusters, and a propulsion system 12. The floating rig 10 and a well head 14 are joined to each other by an excavation riser 16. The thruster or a combination of the thruster and the propulsion system 12 of the floating rig 10 are operated by a dynamic positioning system (DPS) to permit the floating rig 10 to be positioned right above the well head 14 at the sea bottom.

The driving system utilizes, for example, a plurality of artificial satellites 18 constituting a GPS (Global Positioning System) as a position sensor. The position of the rig 10 is adjusted depending on the position information data generated from the GPS so as to make the deviation from a target position zero. Therefore, the apparatus comprises a controller 20 receiving the position information data generated from the GPS artificial satellites 18, as shown in FIG. 1. The controller 20 delivers the received position information data to a deviation calculating section 24 through a filter 22. In the deviation calculating means 24, a three dimensional position of the floating rig 10 on the earth is calculated by utilizing the principle of triangulation. At the same time, since it is possible to define the position on the water surface of the floating rig 10 right above the well head 14 on the sea bottom as a target position on the basis that the three dimensional position of the well head 14 on the sea bottom is known, a deviation between the defined value and the position of the floating rig 10 can be obtained by calculation. Based on the calculated of the deviation, the command signal value to the thrusters, or a combination of the thrusters and the propulsion system 12, is calculated in a main calculating section 26 so as to operate the thrusters or a combination of the thrusters and the propulsion system 12. As a result, the rig 10 is moved to reach the target position.

The apparatus of the present invention further comprises a target 40 position correcting amount calculating section (neural network) 28 and a rig position estimating section 30, which are arranged within the controller 20, in addition to the construction described above. In the present invention, the target position correcting amount calculating section (neural network) 28 and rig position estimating section 30 can be connected to the main calculating section 26 by a switching means 34. Therefore, the switching means selects the input route to the main calculating section 26 from among the deviation calculating section 24, a combination of the deviation calculating section 24 and the target position correcting amount calculating section (neural network) 28, and another combination of the target position correcting amount calculating section (neural network) 28 and the rig position estimating section 30.

Riser angle signals θ u, θ d at the upper and lower ends of the excavation riser 16 are detected by angle detection sensors 32U, 32D, respectively, so as to be supplied to the target position correcting amount calculating section (neural network) 28. The target position correcting amount calculating section (neural network) 28 is a layer type network system. The riser angle signals θ u, θ d are supplied to the input layer of the target position correcting amount calculating section (neural network) 28, with the result that the deviation from the target value that is estimated by the riser angles is outputted from the output layer. The deviation signal thus outputted is supplied to the main calculating section 26. Then, the command value to the thrusters or a combination of the thrusters and the propulsion system 12 is determined in the main calculating means 26 on the basis of the result of calculation of the deviation performed in the deviation calculating means 24. As a result, the thrusters or a combination of the thrusters and the propulsion system 12 is operated so as to permit the rig 10 to reach with the target position.

Riser angle signals θ u, θ d at the upper and lower ends of the excavation riser 16, which are detected by angle sensors 32U, 32D, respectively, are also supplied to the rig position estimating section 30. In the rig position estimating section 30, a deformation mode of the riser is related to the received riser angle signals at the upper and lower ends of the riser to calculate a deformation mode of the riser by an algorithm of a Kalman filter every time the deformation mode of the riser is estimated. Then, the displacement of the upper end of the riser, i.e., the position of the rig, is specified based on the calculated deformation mode of the riser. The specified displacement is supplied to the main calculating section 26 and the command signal value to the thrusters or a combination of the thrusters and the propulsion system 12 is calculated in the main calculating section 26 based on the result of the deviation calculation, as in the case where the main calculating section 26 has received an input signal from the deviation calculating section 24. As a result, the thrusters or a combination of the thrusters and the propulsion system 12 is operated to move the rig 10 such that the rig 10 is aligned with the target position obtained by the target position correcting amount calculating section (neural network) 28.

The target position correcting amount calculating section (neural network) 28 is allowed to learn in advance the position information of the floating rig 10 in relation to the behaving characteristics of the excavation riser 16. To be more specific, the position information of the floating rig 10 based on the angle information on the upper and lower ends, at which the angle of inclination is particularly large, of the excavation riser 16 is related to the various properties of the riser by an error inverse propagation method so as to output instantly the deviation of the rig 10 based on only the angle information on the upper and lower ends. By this learning and supplying the inclination angles θ u, θ d at the upper and lower ends of the excavation riser 16 to the target position correcting amount calculating section (neural network) 28, the deviation information between the present position and the target position of the floating rig 10 is output. As a result, the thrusters, or a combination of the thrusters and the propulsion system 12, are operated to permit the floating rig 10 to be held appropriately at the target position.

In the embodiment described above, the switching means 34 selects the input route to the main calculating section 26 from among the deviation calculating section 24, a combination of the deviation calculating section 24 and the target position correcting amount calculating section (neural network) 28, and another combination of the target position correcting amount calculating section (neural network) 28 and the rig position estimating section 30. Therefore, where the position information from the GPS is obtained, the target position correcting amount calculating section (neural network) 28 automatically outputs a signal to drive the thrusters, or a combination of the thrusters and the propulsion system 12, in a manner to diminish the riser angle based on the detected values of the angles of inclination at the upper and lower ends of the riser. It follows that the position is automatically corrected without requiring the correcting operation performed by the operator.

Where the position information from, for example, a GPS cannot be obtained because of a bad marine weather conditions, the switching means 34 is operated to employ the combination of the target position correcting amount calculating section (neural network) 28 and the rig position estimating section 30. As described previously, the position estimating section 30 estimates a deformation mode of the riser by using the supplied signals representing the angles at the upper and lower ends of the riser, calculates the deformation mode of the riser in accordance with algorithm of a Kalman filter every time the deformation mode of the riser is estimated, and specifies the displacement at the upper end of the riser, i.e., position of the rig, based on the calculated deformation mode of the riser, thereby determining the rig position. At the same time, the target position correcting amount calculating section (neural network) 28 calculates the correcting amount for diminishing the angles of inclination at the upper and lower ends of the riser based on the detected values of the angles of inclination at the upper and lower ends of the riser. These outputs are supplied to the main calculating section 26. As a result, the main calculating section 26 automatically outputs a signal to the drive unit (not shown) to drive the thrusters, or a combination of the thrusters, and the propulsion system 12, in a manner to diminish the angles of inclination at the upper and lower ends of the riser. It follows that, even where the GPS signal or the like has ceased to be received, the rig position can still be automatically corrected effectively.

As described above, in the present invention, the neural network is allowed to learn in advance the position information of a floating rig in relation to the characteristics of the excavation riser. Also, the angles of inclination at the upper and lower ends of the excavation riser are detected and supplied to the neural network so as to allow the neural network to output the correcting information of the present position of the floating rig. Further, the floating rig is controlled based on the position correcting information so as to be driven to the position where the angles of inclination at the upper and lower ends of the riser are diminished. It follows that the rig position can be controlled directly to control the angles at the upper and lower ends of the riser. Therefore, even where the conventional DPS control is performed on the basis of the position information, the control method of the present invention can be employed for diminishing the angles of inclination at the upper and lower ends of the riser in the case where the excavation is performed by connecting the riser, making it possible to control directly the rig position to diminish the angles at the upper and lower ends of the riser. Naturally, the method of the present invention provides an excellent control that can be substituted for conventional methods in which the DPS target position is manually corrected by the operator.

It should be noted in particular that the apparatus of the present invention is constructed to permit switching to employ, in combination, a method, in which a deviation from the target position is calculated by a position sensor of the floating rig, the angles of inclination at the upper and lower ends of the excavation riser are detected and supplied to the neural network so as to allow the neural network to output the information on the correcting value of the present position of the floating rig, and the floating rig is moved to the target position based on the position information, and another method, in which the angles of inclination at the upper and lower ends of the excavation riser are detected and the detected values are supplied to the rig position estimating section, so as to drive the floating rig to the target position. By incorporating the system of the present invention in parallel with a DPS having a conventional position information system or by incorporating the invention's second control method as a back up system, it is possible to construct a DPS system having a higher redundancy.

What is claimed is:

1. A method of controlling the position of a floating rig, in which the floating rig is joined to the well head at the sea bottom by an excavation riser and the position of the floating rig can be corrected by thrusters or a combination of thrusters and a propulsion system, comprising the steps of:

allowing a neural network to learn in advance the position information of the floating rig in relation to the behaving characteristics of the excavation riser; and detecting the angles of inclination at the upper and lower ends of the excavation riser and supplying them to the neural network so as to allow the neural network to output the information on the correction of the present position of the floating rig, thereby driving the floating rig based on the information on the correction of the present position of the rig to a position where the angles of inclination at the upper and lower ends of the riser are diminished and, thus, controlling the position of the floating rig at the position where the angles of inclination at the upper and lower ends of the riser are diminished.

2. A method of controlling the position of a floating rig, in which the floating rig is joined to the well head at the sea bottom by an excavation riser and the position of the floating rig can be corrected by thrusters or a combination of thrusters and a propulsion system, comprising the steps of:

calculating a deviation in the rig position on the basis of the position information supplied from the means for detecting the position information of the rig;

allowing a neural network to learn in advance the position information of the floating rig in relation to the behaving characteristics of the excavation riser; and supplying the information on the detected angles to the neural network, thereby allowing the neural network to output the information on the correcting amount of the target position of the floating rig and driving the thruster or a combination of the thruster and a propulsion system to perform correction of the rig position while diminishing the angle of inclination of the excavation riser.

3. A method of controlling the position of a floating rig, in which the floating rig is joined to the well head at the sea bottom by an excavation riser and the position of the floating rig can be corrected by thrusters or a combination of thrusters and a propulsion system, comprising the steps of:

allowing a neural network to learn in advance the position information of the floating rig in relation to the behaving characteristics of the excavation riser;

detecting the angles of inclination at the upper and lower ends of the excavation riser;

supplying the information on the detected angles to the neural network, thereby allowing the neural network to output the information on the correcting amount of the target position of the floating rig;

estimating the position of the floating rig based on the received information on the detected angles;

obtaining a deviation between the estimated position and the target position; and driving the thrusters or a combination of the thrusters and a propulsion system to perform correction of the rig position while diminishing the angle of inclination of the excavation riser.

4. An apparatus for controlling the position of a floating rig, in which the floating rig is joined to the well head at the sea bottom by an excavation riser and the position of the floating rig can be corrected by thrusters or a combination of thrusters and a propulsion system, comprising:

a target position deviation calculating section for calculating the deviation in the rig position based on the position information supplied from the means for detecting the rig position;

a target position correcting amount calculating section, in which a neural network is allowed to learn in advance the position information of the floating rig in relation to the behaving characteristics of the excavation riser and the angles of inclination at the upper and lower ends of the excavation riser are detected and supplied to the neural network to permit the neural network to output the information on the target position correcting amount of the floating rig to diminish the angles of inclination at the upper and lower ends of the excavation riser;

a position estimating section for obtaining a deviation between the target position and the estimated floating rig position based on detected angles of inclination at the upper and lower ends of the excavation riser;

a main calculating section for outputting a command value to the thrusters or a combination of the thrusters and a propulsion system; and a switching means that selects the input route to the main calculating section from among the deviation calculating section, a combination of the deviation calculating section and the target position correcting amount calculating section, and another combination of the target position correcting amount calculating section and the rig position estimating section.

* * * * *